United States Patent [19]

Curutchet

[11] Patent Number: 4,671,178

[45] Date of Patent: Jun. 9, 1987

[54] LOW ENERGY FUSES

[75] Inventor: Jean L. Curutchet, Johannesburg, South Africa

[73] Assignee: AECI Limited, Johannesburg, South Africa

[21] Appl. No.: 748,557

[22] Filed: Jun. 25, 1985

[30] Foreign Application Priority Data

Jul. 10, 1984 [ZA] South Africa ..... 84/5404

[51] Int. Cl.[4] ..... C06C 5/00

[52] U.S. Cl. ..... 102/275.1; 102/275.8

[58] Field of Search ..... 102/275.1, 275.12, 275.2, 102/275.3, 275.4, 275.5, 275.6, 275.7, 275.8, 275.9, 275.10, 275.11, 324, 323, 328, 329, 330; 89/1.14

[56] References Cited

U.S. PATENT DOCUMENTS

| | | | |
|---|---|---|---|
| 2,558,134 | 6/1951 | Hall | 102/275.9 |
| 2,587,694 | 3/1952 | Chalmers et al. | 102/275.4 |
| 3,049,079 | 8/1962 | Eilo | 102/324 |
| 3,064,572 | 11/1962 | Aitchison | 102/324 X |
| 3,368,485 | 2/1968 | Klotz | 102/275.2 |
| 3,404,598 | 10/1968 | Angelos | 89/1.14 |
| 3,621,558 | 11/1971 | Welsh et al. | 102/275.9 |
| 3,739,724 | 6/1973 | Tlam | 102/275.9 |
| 3,881,417 | 5/1975 | Mesia | 102/324 X |
| 3,949,673 | 4/1976 | Lyerly | 102/324 X |
| 4,328,753 | 5/1982 | Kristensen et al. | 102/275.5 |
| 4,458,576 | 7/1984 | Ayers | 102/275.11 X |
| 4,493,261 | 1/1985 | Simon et al. | 102/275.11 |

FOREIGN PATENT DOCUMENTS

| | | |
|---|---|---|
| 1578274 | 6/1969 | France . |
| 555767 | 9/1943 | United Kingdom . |

*Primary Examiner*—David H. Brown

*Attorney, Agent, or Firm*—Cushman, Darby & Cushman

[57] ABSTRACT

A low energy fuse which has a tubular casing that is deformed at at least one end and intermediate its ends to form valve formations. Each valve formation defines a valve that is normally substantially closed and which is opened, in use, by a shock wave. Wall material of the casing may be deformed by heated displaceable forming elements. The deformed wall portions may be fused or bonded together to form an hermetic seal, the fusion or bond being sufficiently weak to be ruptured by the shock wave. Instead the deformed wall portions may merely touch one another or may be spaced slightly apart to define an aperture which is substantially smaller than the cross-sectional area of the casing.

17 Claims, 12 Drawing Figures

LOW ENERGY FUSES

This invention relates to low energy fuses. Further, it relates to methods of manufacturing and modifying a low energy fuse and to apparatus for manufacturing and modifying the fuses.

This specification is particularly directed to low energy fuses consisting of an elongate casing in the form of a tubular, rigid or flexible conductor, which contains a quantity of explosive and/or reactive substance distributed along the conductor, which fills up only part of the cross-section of the conductor. The rest of the conductor is filled with gas. An embodiment of such a fuse is known by the name "Nonel".

According to the invention there is provided a low-energy fuse which includes an elongate tubular casing that has a valve formation which defines a valve that is normally substantially closed and which is opened, in use, by a shock wave.

Further according to the invention there is provided a method of modifying a low-energy fuse which includes a length of an elongate tubular casing, which includes deforming a wall portion of the casing to form a valve formation which defines a valve that is normally substantially closed and which is opened, in use, by a shock wave.

Further according to the invention there is provided a method of manufacturing a low-energy fuse which includes providing a length of elongate tubular casing; and deforming wall portions of the casing to form a valve formation which is normally substantially closed and which is opened, in use, by a shock wave.

Further according to the invention there is provided an apparatus for manufacturing a low-energy fuse from a length of an elongate tubular casing, which includes a deforming means for deforming a wall portion of the casing to form a valve that is normally substantially closed and which is opened, in use, by a shock wave.

Further according to the invention there is provided an apparatus for modifying a low-energy fuse that includes a length of an elongate tubular casing, which includes a deforming means for deforming a wall portion of the casing to form a valve that is normally substantially closed and which is opened, in use, by a shock wave.

The valve formation may be formed from material of the casing and may be such that it closes after the shock wave has passed. The valve formation may further define a constriction.

In a preferred embodiment, the casing may be of a thermo-plastic material. The valve formation may then be formed by heating that portion of the casing where the valve is desired to be and deforming it to form the valve formation. It will be appreciated that the valve formation may be located at an end of the casing or at any position intermediate its ends. The fuse may be manufactured by deforming the casing close to an end, or intermediate its ends, to define two sections, and parting the sections at the place of deformation, one section then being used to form the fuse, the valve then being at an end thereof.

It will be understood that opposed sides of the casing may be relatively displaced towards one another. Thus, opposed regions may both be displaced inwardly or one side may be displaced beyond a central axis towards the other side. Further, the valve formation may have any suitable profile. Thus, with a valve formation occurring at an end of the casing it may define a straight edge which extends from one side of the casing to the other. This straight edge may be at an angle to the longitudinal axis of the casing or it may be straight across. The valve formation may also have two straight edges which intersect one another at a suitable angle such that the casing has a pointed appearance. The angle between these straight edges may vary and the relative lengths of these straight edges may vary. Instead, the valve formation may define a curved edge.

It will be appreciated still further that the valve formation may be formed by having two relatively displaceable heated elements that crimp the casing between them. In effect, with a valve formation that is located at the end of the casing, two inwardly directed lips are formed. The angle of these lips with respect to the longitudinal axis of the casing will depend on the shape and configuration of these forming elements. These lips may accordingly define any suitable angle with the longitudinal axis which may be between 15° and 75°.

The two lips may bond or fuse with one another to a predetermined extent to ensure that the casing is hermetically sealed. However, this bond or fusion is then sufficiently weak to be ruptured when a shock wave arrives at the valve formation. Instead, the lips may touch one another, or may be spaced slightly apart to define an aperture that is substantially smaller than the cross-sectional area of the casing.

At positions intermediate the ends of the casing, the valve formation may take the form of a constriction. Thus, wall portions of the casing may be inwardly deformed to provide a relatively small opening or to close off the casing.

The invention is now described, by way of examples, with reference to the accompanying drawings, in which.

Figure 1:
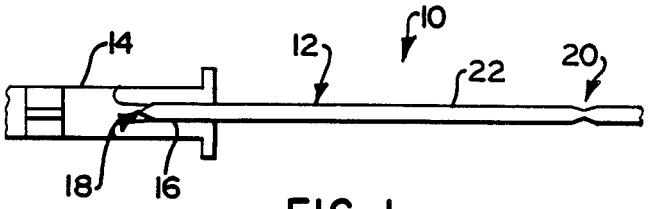
FIG. 1 shows part of a detonator assembly which includes a low energy fuse in accordance with the invention.

Referring to FIG. 1, shown therein is part of a detonator assembly, which is designated generally by reference numeral 10. The detonator assembly 10 is formed from a length of Nonel fuse 12 and a detonator 14. The Nonel fuse 12 has an end 16 which is located within the detonator 14. A valve formation 18 is formed at this end 16. The Nonel fuse has a number of other valve formations 20 intermediate its ends. One of these valve formations 20 is shown.

The Nonel fuse 12 comprises a length of hollow tubing 22 which is made of a synthetic plastics material known as "Surlyn". The tubing 22 contains a quantity of explosive which is distributed along its length. This explosive is not shown in the drawings.

Figure 2:
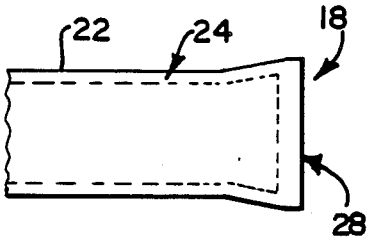
FIG. 2 shows a plan view of a valve formation located at an end of a length of tubing forming the fuse.
Figure 3:
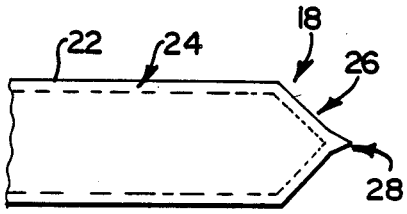
FIG. 3 shows a side view of the end of the tubing shown in FIG. 2.
Figure 4:
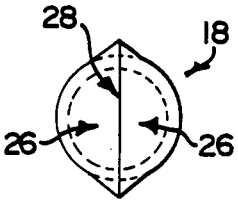
FIG. 4 shows an end view of the tubing of FIGS. 2 and 3.
Figure 5:
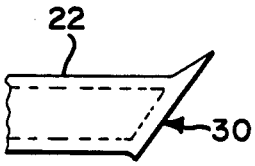
FIG. 5 shows a plan view of a further valve formation formed at an end of a length of tubing.
Figure 6:
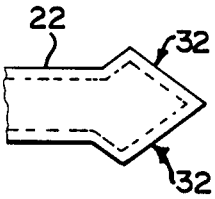
FIG. 6 shows a plan view of a still further embodiment of a valve formation formed at an end of a length of tubing.
Figure 7:
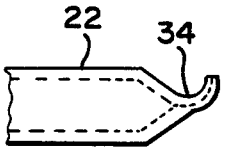
FIG. 7 shows a side view of a still further embodiment of a valve formation formed at an end of a length of tubing.

Referring now to FIGS. 2, 3 and 4, the valve formation 18 is shown in more detail. Thus, as is clearly seen in FIGS. 2, 3 and 4 the tubing 22 has a wall 24 and end regions 26 are deformed towards one another to define a straight edge 28 which extends across the end of the tubing 22 and is perpendicular to a longitudinal axis of the tubing 22. Further, peripheral portions of the end regions 26 are fused or bonded together such that the interior of the tubing 22 is hermetically sealed. However, the fusion or bond is sufficiently weak that when a shock wave reaches the end of the tubing the end regions 26 are forced apart allowing the shock wave to pass into the detonator 14. Once the shock wave has passed, the end regions 26 return to their original position thereby sealing the detonator and maintaining pressure within the detonator. As pressure is maintained within the detonator 14, failures due to venting of the detonator are minimised and more consistent delay times are provided. Protection is provided against sparks between the end of the tubing and a sealer element placed in the detonator casing. It will be appreciated that the end regions could merely touch one another or be spaced slightly apart.

FIGS. 5, 6, 7 and 8 show further embodiments of valve formations. As these valve formations are substantially similar to the valve formation 18 shown in FIGS. 2, 3 and 4, except that they have slightly different shapes and configurations, they will not be discussed in detail. However, the valve formation shown in FIG. 5 has a straight edge 30 which extends at an angle to the longitudinal axis of the tubing 22; the valve formation shown in FIG. 6 has two straight edges 32 that define an acute angle between themselves such that the end of the tubing 22 has a pointed appearance; the valve formation shown in FIG. 7 has a bent over lip portion 34; and the valve formation shown in FIG. 8 has a curved edge 35.

Figure 9:
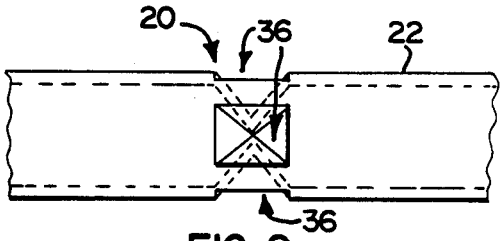
FIG. 9 shows a plan view of a valve formation formed intermediate the ends of a length of tubing.
Figure 10:
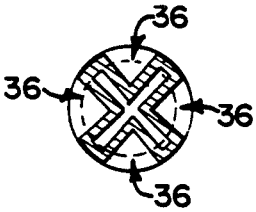
FIG. 10 shows a sectional view of the valve formation shown in FIG. 9.
Figure 8:
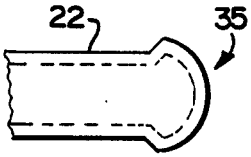
FIG. 8 shows a plan view of a still further embodiment of a valve formation formed at an end of a length of tubing.

Referring now to FIGS. 9 and 10, the valve formation 20 is shown. The valve formation 20 comprises a constriction in the tubing 22 formed by making four pyramidal indentations 36. These indentations 36 may meet such that the tubing 22 is completely closed off or may come close to one another such that the tubing 22 is substantially closed.

Figure 11:
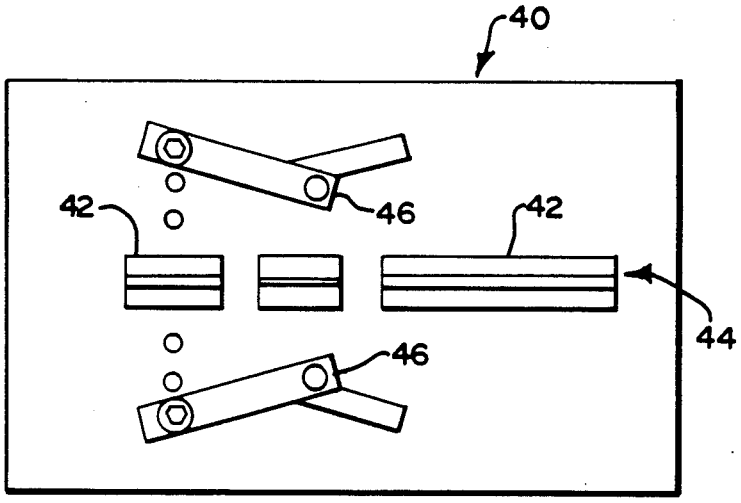
FIG. 11 shows schematically a prototype apparatus utilised to form a valve formation at the end of a length of tubing.

Referring now to FIG. 11, shown therein by reference numeral 40 is a prototype apparatus for forming the valve formation 18. Thus, the apparatus 40 has retaining elements 42 which define a seating groove 44 in which the tubing 22 is located. Two opposed forming elements 46 are located on opposite sides of the elements 42 and are pivotally mounted to be displaceable towards the elements 42. The deforming elements 46 are heated such that upon contact thereof with the tubing 22 the tubing 22 is heated to a temperature above the softening point temperature of the Surlyn to deform the tubing 22 and form the valve formation 18. Preferably, the apparatus 40 forms the valve formation 18, cuts the tubing 22 at the valve formation and forms a heat seal on the other side of the cut.

Figure 12:
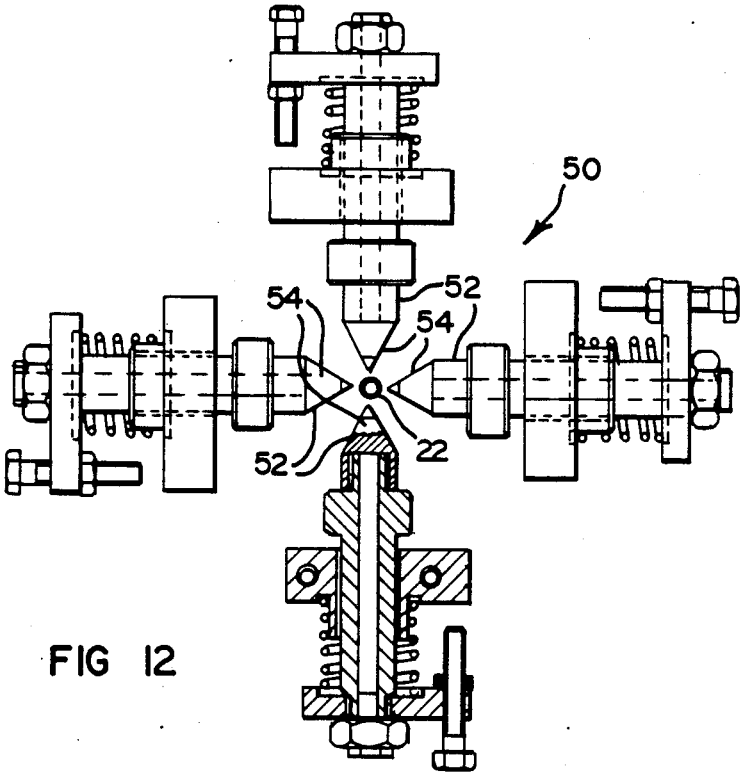
FIG. 12 show schematically part of a further prototype apparatus utilised to form the valve formation shown in FIGS. 9 and 10.

Referring to FIG. 12, a further apparatus 50 is shown for forming the valve formation 20. The apparatus 50 has four deforming pins 52 that are disposed at 90° to one another in a plane such that the tubing 22 is receivable in the area between opposed tips 54 of the pins 52. The tips 54 are pyramidal or conical. The pins 52 are further mounted to be displaceable together towards one another by a suitable mechanism (not shown). The tips 54 of the pins 52 are heated such that upon engagement thereof—with the tubing 22 the tubing is heated and deformed.

It will be appreciated that the valve formations 20 have the effect of minimising powder migration within the tubing 22, provide an inbuilt delay by reducing the speed of the shock wave and may provide initiation points for secondary lines of Nonel fuses.

I claim:

1. A low-energy fuse comprising an elongate tubular casing containing a quantity of explosive substance distributed along, but filling only part of the cross-section of the casing, the remainder of the casing being filled with gas: said casing having at least one valve formation of thermoplastics material, said valve formation being opened, in use, by a shock wave propagating in the casing and being resilient so that it closes after the shock wave has passed through it.

2. The fuse as claimed in claim 1, in which the valve formation defines a constriction.

3. The fuse as claimed in claim 1, in which the valve formation is intermediate the ends of the casing.

4. The fuse is claimed in claim 1, in which the valve formation is defined by a number of inwardly deformed wall portions of the casing which lie in a transverse plane.

5. The fuse as claimed in claim 1, in which the valve formation has at least two elements that are relatively displaceable away from one another.

6. The fuse as claimed in claim 5, in which the elements are bonded together to normally hermetically seal the casing, the bond between them being sufficiently weak to be ruptured, in use, by the shock wave.

7. The fuse as claimed in claim 5, in which the elements touch one another.

8. The fuse as claimed in claim 5, in which the elements are close together to provide an aperture which is substantially smaller than the internal cross-sectional area of the casing.

9. The fuse as claimed in claim 1, in which the valve formation is at an end of the casing.

10. The fuse as claimed in claim 9, in which the valve formation defines a curved edge.

11. The fuse as claimed in claim 9, in which the valve formation defines two straight edges which intersect one another.

12. The fuse as claimed in claim 9, in which the valve formation defines a straight edge.

13. The fuse as claimed in claim 12, in which the straight edge is at 9° to a longitudinal axis of the casing.

14. The fuse as claimed in claim 1, in which the casing is of a thermo-plastic material and the valve formation is defined by portions of the casing that have been heated and deformed.

15. The fuse as claimed in claim 14, in which the valve formation is defined by opposed sides of the casing that are angled towards one another.

16. The fuse as claimed in claim 15, in which each of the opposed sides of the casing defines an angle of between 15° and 75° with the longitudinal axis of the casing.

17. The fuse as claimed in claim 15, in which the opposed sides of the casing define an angle of about 90° between them.

* * * * *